US012680559B2

(12) United States Patent
Augenstein et al.

(10) Patent No.: US 12,680,559 B2
(45) Date of Patent: Jul. 14, 2026

(54) SUPPORTING FRAME FOR A FAN, FAN ASSEMBLY WITH SUPPORTING FRAME, AND HEAT EXCHANGER ASSEMBLY WITH FAN ASSEMBLY

(71) Applicant: MAHLE International GmbH, Stuttgart (DE)

(72) Inventors: Claus Augenstein, Gerlingen (DE); Markus Schatz, Fellbach (DE); Stephan Posset, Lauffen am Neckar (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 19/276,365

(22) Filed: Jul. 22, 2025

(65) Prior Publication Data

US 2026/0028999 A1 Jan. 29, 2026

(30) Foreign Application Priority Data

Jul. 23, 2024 (DE) ..... 102024120856.2

(51) Int. Cl.
*F04D 29/64* (2006.01)
*F04D 19/00* (2006.01)
*F04D 29/52* (2006.01)

(52) U.S. Cl.
CPC ..... *F04D 29/646* (2013.01); *F04D 19/002* (2013.01); *F04D 29/522* (2013.01)

(58) Field of Classification Search
CPC ..... F04D 29/646; F04D 29/522; F04D 19/002
See application file for complete search history.

(56) References Cited

U.S. PATENT DOCUMENTS

| | | | | |
|---|---|---|---|---|
| 8,672,615 | B2 * | 3/2014 | Ruckert | F04D 25/0613 415/214.1 |
| 2009/0211287 | A1 * | 8/2009 | Steele | B60H 1/3227 416/189 |
| 2009/0226299 | A1 | 9/2009 | Jin | |
| 2015/0159892 | A1 * | 6/2015 | Jung | F04D 19/002 415/213.1 |
| 2023/0104481 | A1 | 4/2023 | Benzakroum et al. | |

FOREIGN PATENT DOCUMENTS

| | | | |
|---|---|---|---|
| DE | 10204830 | A1 | 6/2003 |
| DE | 102013015835 | A1 | 4/2015 |
| DE | 102017012255 | A1 | 5/2019 |

OTHER PUBLICATIONS

German Examination Report, dated May 8, 2025, for Application No. 10 2024 120 856.2, 3 pages.

* cited by examiner

*Primary Examiner* — Michael L Sehn
(74) *Attorney, Agent, or Firm* — Barnes & Thornburg

(57) ABSTRACT

A supporting frame for a fan for a heat exchanger is provided.
The supporting frame (1) has at least three legs, wherein at least one of the legs has a J-shaped cross section, in which one of the walls is higher than the other wall.
A fan assembly that has such a supporting frame and a heat exchanger that has such a fan assembly is also provided.

14 Claims, 4 Drawing Sheets

SUPPORTING FRAME FOR A FAN, FAN ASSEMBLY WITH SUPPORTING FRAME, AND HEAT EXCHANGER ASSEMBLY WITH FAN ASSEMBLY

CROSS-REFERENCE TO RELATED APPLICATIONS

This application claims priority from German Patent Application No. DE 102024120856.2, filed on Jul. 23, 2024, the entirety of which is incorporated by reference herein.

The present invention relates to a supporting frame for a fan for a heat exchanger. The invention also relates to a fan assembly with such a supporting frame and fan. The invention also relates to a heat exchanger assembly with such a fan assembly.

When a heat exchanger through which air flows is in use, a fan causes the air to flow through the heat exchanger. The fan is attached to the heat exchanger for this. A supporting frame can be used to attach the fan to the heat exchanger. This supporting frame can be made of plastic or sheet metal.

The increasing demands for more powerful heat exchangers require more powerful fans. This normally results in heavier fans.

The object of the present invention is to create better or at least different embodiments of such a supporting frame for a fan assembly, comprising a fan and a supporting frame, and a heat exchanger assembly that comprises a heat exchanger and such a fan assembly.

This is achieved with the invention by the subject matter of the independent claims. Advantageous embodiments are the subject matter of the dependent claims.

The present invention is based on the fundamental concept of creating a supporting frame for a fan for a heat exchanger in the form of a frame with legs that have a J-shaped cross section with walls of different heights in relation to the direction in which the fan rotates. A supporting frame increases the mechanical stability while reducing the weight. This makes it possible to accommodate more powerful fans with a supporting frame that is lighter than one made with tubes. This results in greater efficiency, in particular when used in mobile applications. The walls of different heights also prevent or reduce vibrations and oscillations in the supporting frame, as well as preventing or at least reducing turbulences and improving aerodynamic properties. The result is greater efficiency while functioning more quietly.

The frame obtained with the invention, hereinafter referred to as the supporting frame, has a receiving space that is open in the axial direction for the fan. The supporting frame also has three legs spaced apart over its circumference, which support the receiving space. The legs extend between the receiving space and their feet with which the supporting frame is attached to the heat exchanger. At least one of the legs, preferably all of the legs, has a J-shaped cross section, comprised of a base and two walls extending therefrom. The leg therefore has a first wall and second wall, both of which extend from the base. The first wall is downstream of the second wall in the direction of rotation. The first wall has a first axial height, and the second wall has a second axial height. The second height is between 20% and 80% of the first height.

The directions in the present case relate to the axial direction, which preferably corresponds to a rotational axis of the fan, or is parallel to the rotational axis. The rotational direction thus encircles the axial direction. The rotational direction preferably corresponds to the direction in which the fan rotates when in use.

The supporting frame can theoretically have any number of legs equal to or greater than three.

Variations in which the supporting frame has four such legs are regarded as advantageous. In this case, the feet thereof are preferably in corners of an imaginary/virtual square.

The first axial height is also referred to below as the first height, and the second axial height as the second height, for purposes of brevity.

Advantageous reductions in noise paired with improvements in aerodynamic properties are obtained when the second height is between 30% and 70% of the first height.

The respective walls can be of any height, as long as the second height is between 20% and 80%, in particular 30% and 70% of the first height.

The first height is between 10 mm and 40 mm in advantageous variations. The first height is preferably between 15 mm and 35 mm.

In theory, the first and second walls can be parallel to one another.

In preferred embodiments, the first and second walls are at an angle of between 15° and 65° to one another. This angle is preferably between 20° and 60°. This tilting of the walls results in a particularly advantageous aerodynamic behavior of the supporting frame and reduced turbulences, as well as a particularly effective reduction in oscillations and vibrations of the supporting frame. This increases efficiency, and reduces noise.

At least one of the legs has a retainer in its J-shaped cross section for an electrical wire that supplies the fan with electricity. The retainer is preferably a rubber tube. This places the wire outside the air flow and within the cross section. In addition to resulting in a more compact design, this also simplifies assembly. The rubber also prevents oscillations and vibrations in the retainer, thus preventing, or at least reducing, noises.

The supporting frame can be produced with a variety of methods.

By way of example, the supporting frame can be a deep-drawn component, e.g. stamped steel sheet metal.

In preferred variations, the supporting frame is cast. In particular, the supporting frame is cast light metal or a light metal alloy. By way of example, the supporting frame can be made of cast aluminum or magnesium. This results not only in a simplified production, but also in a lighter supporting frame.

The supporting frame can also be made of a hybrid plastic, which comprises an injection-molded part with a steel inlay and high-tensile fiber-reinforced plastic.

It is understood that in addition to the supporting frame, an assembly comprising the supporting frame and a fan, hereinafter referred to as the fan assembly, also belongs to the scope of this invention. The fan is placed in the receiving space. The fan also rotates when in use.

The supporting frame makes it possible to use heavier and/or more powerful fans.

By way of example, the fan can weigh at least 4 kg, in particular at least 10 kg.

By way of example, the fan can have an output of at least 5 kW, in particular between 5 kW and 15 kW.

Advantageous embodiments have a cover plate on the receiving space, which is on the side thereof facing away from the feet and thus the heat exchanger, that covers and mechanically protects a drive, in particular an electric motor, for the fan. This increases the service life of the fan assembly.

The cover plate can be releasably attached to the receiving space with threaded fasteners.

It is understood that in addition to the fan assembly, the invention also includes an assembly that has a fan assembly and a heat exchanger, hereinafter referred to as a heat exchanger assembly.

An air flow path passes through the heat exchanger, through which the fan conveys air when in use. The supporting frame, and thus the fan assembly, are attached to the heat exchanger by the feet on the supporting frame in the heat exchanger assembly. This attachment can be obtained with threaded fasteners.

The heat exchanger assembly can theoretically be used in any number of applications. In particular, it can be used in mobile applications.

In particular, the heat exchanger assembly can be used in an electric vehicle, e.g. an electric truck.

Other important features and advantages of the invention can be derived from the dependent claims, the drawings, and the descriptions thereof.

It is understood that the features specified above and explained below can be used not only in the given combinations, but also in other combinations or in and of themselves, without abandoning the scope of the invention.

Preferred exemplary embodiments of the invention are shown in the drawings and shall be explained in greater detail below in reference to the drawings, in which the same reference symbols are used for identical or functionally identical components.

Therein, schematically:

Figure 2:
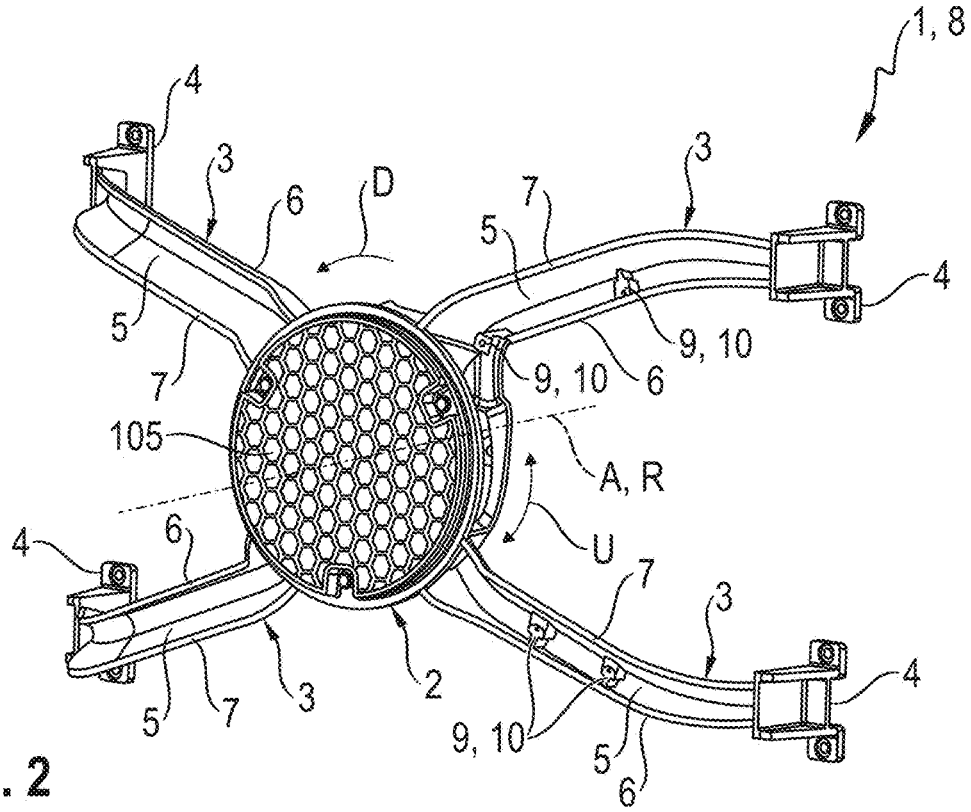
FIG. 2 shows an isometric view of the supporting frame.
Figure 3:
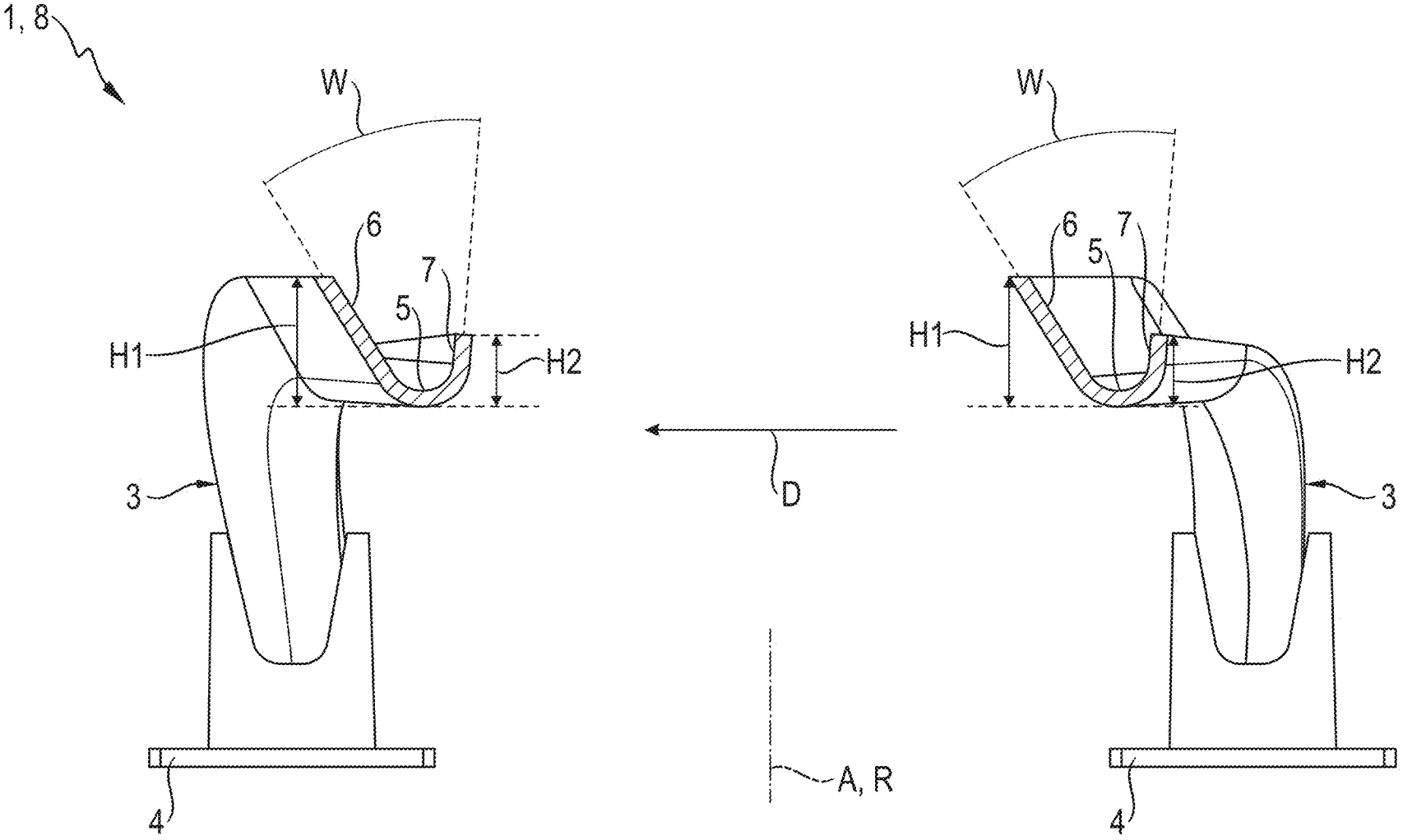
FIG. 3 shows sectional view of the supporting frame cut through the plane indicated by III-IIII in FIG. 1.
Figure 4:
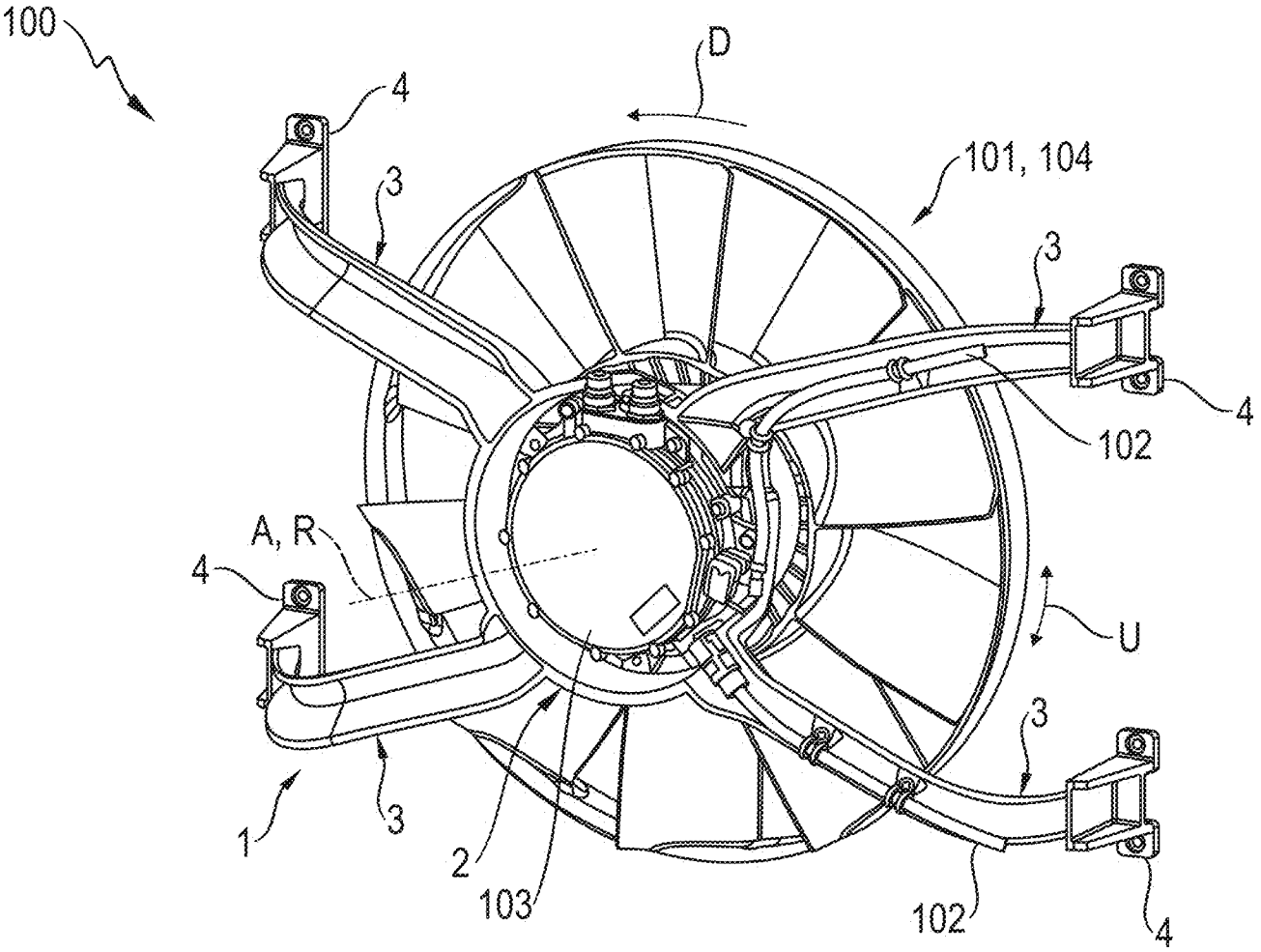
FIG. 4 shows an isometric view of a fan assembly with the supporting frame.
Figure 5:
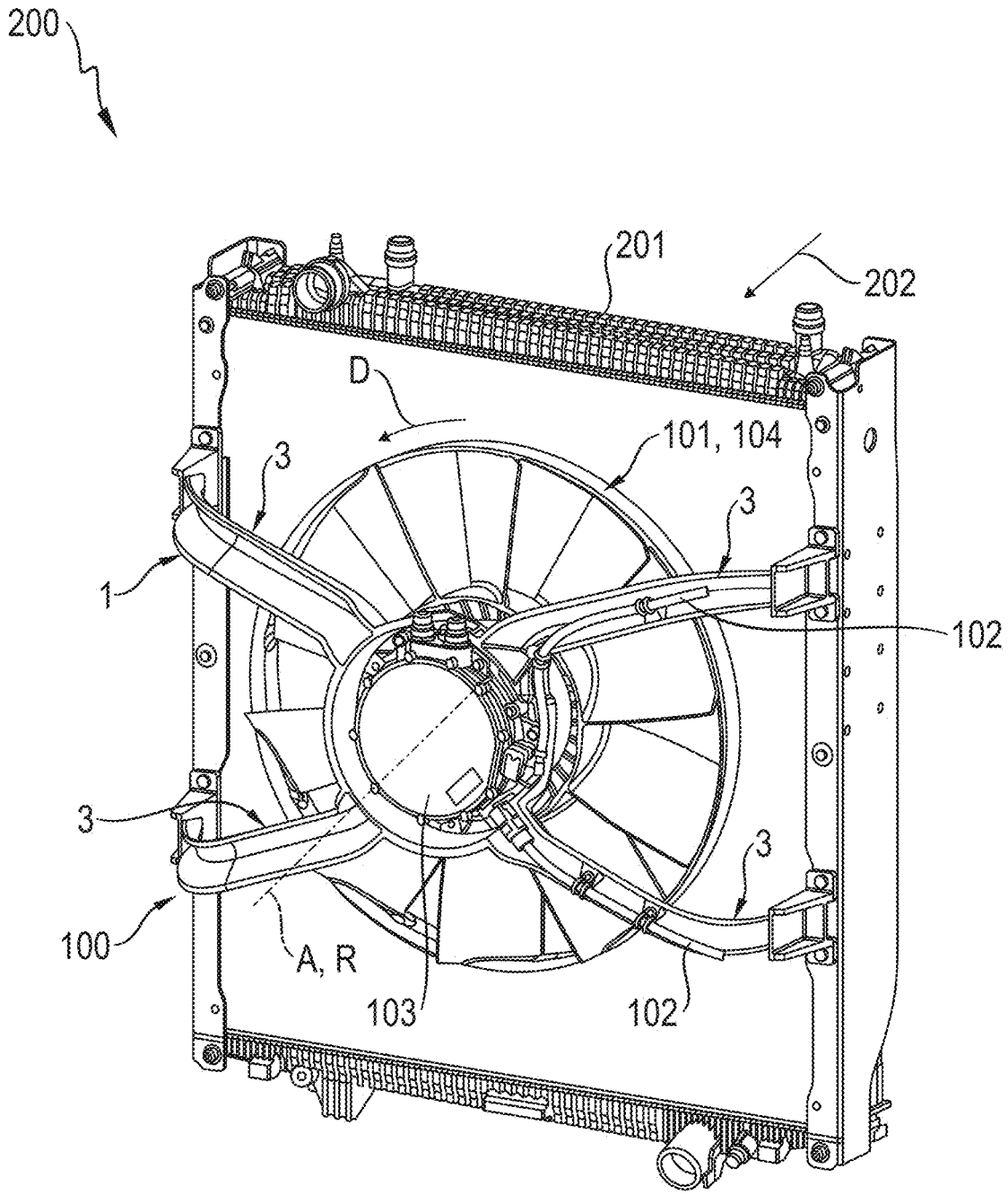
FIG. 5 shows an isometric view of a heat exchanger assembly with the fan assembly.

A supporting frame 1 shown by way of example in FIGS. 1 to 5 is used in a fan assembly 100 shown by way of example in FIGS. 4 and 5 to support a fan 101. The fan assembly 100 can be used in a heat exchanger assembly 200, shown in FIG. 5 by way of example, that has a heat exchanger 201.

Figure 1:
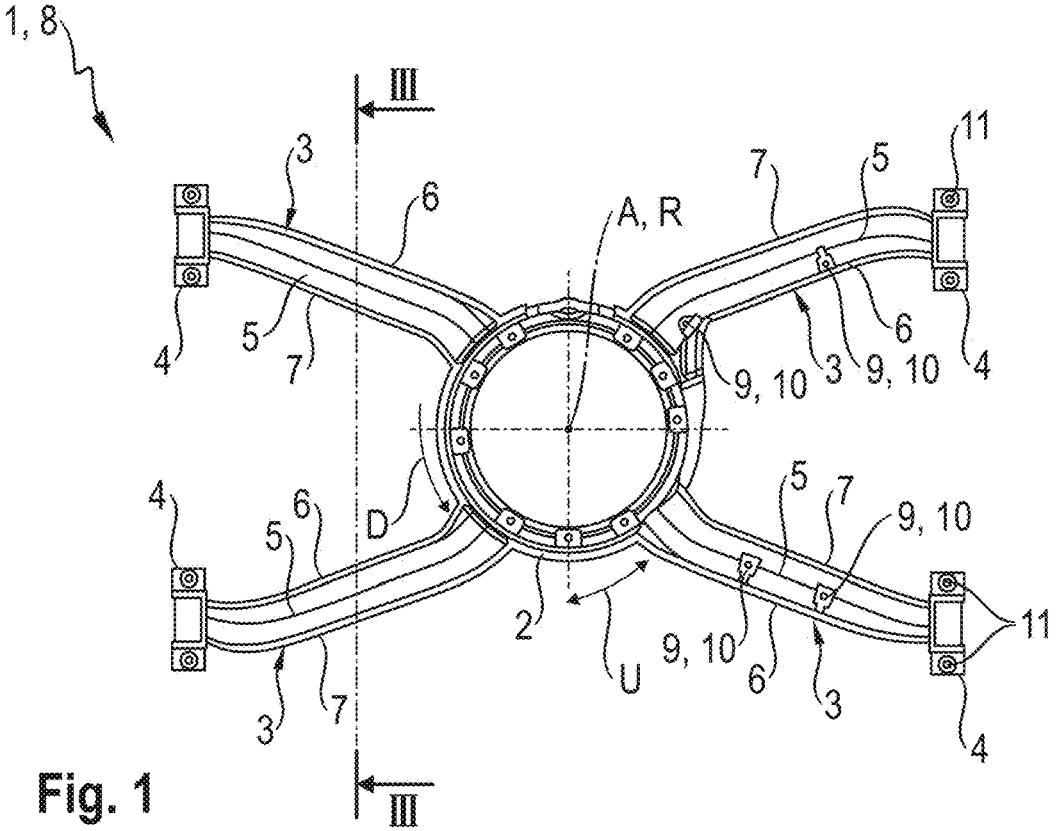
FIG. 1 shows a supporting frame from above.

As can be clearly seen in FIGS. 1 and 2, the supporting frame 1 has a receiving space 2 for the fan 101, which is open in the axial direction A. The axial direction A preferably corresponds to a rotational axis R for the fan 101 in these exemplary embodiments (see FIG. 4). The fan rotates 101 in a rotational direction D in relation to the axial direction A and thus the rotational axis R. Legs 3, of which there are at least three on the supporting frame 1, extend away from the receiving space 2. The legs are spaced apart about the circumference U. In these exemplary embodiments, the supporting frame 1 has four legs 3. The legs 3 have feet 4 on their ends, each of which connects the supporting frame 1, and thus the fan 101, to the heat exchanger 201, as can be seen in FIG. 5, e.g. using threaded fasteners 11. At least one of the legs 3 has a J-shaped cross section, as can be seen in FIG. 3. Each of the legs 3 has a J-shaped cross section in these exemplary embodiments. They therefore have a curved bottom or base 5 and two walls 6, 7, specifically a first wall 6 and second wall 7. The first wall 6 is downstream of the second wall 7 in the rotational direction D.

As shown in FIG. 3, the first wall 6 has a first axial height H1 starting from the base 5, hereinafter referred to simply as the first height H1, and the second wall 7 has a second axial height H2, hereinafter referred to simply as the second height H2. As can be seen in FIG. 3, the second height H2 is shorter than the first height H1. The second height H2 is between 20% and 80% of the first height H1. In these exemplary embodiments, the second height H2 is between 30% and 70% of the first height H1. The second height H2 in these exemplary embodiments is between 10 mm and 40 mm, in particular between 15 mm and 35 mm.

As can be seen in FIG. 3, the two walls 6, 7 in these exemplary embodiments are not parallel to one another. Instead, the first wall 6 and second wall 7 are at an angle W to one another. The angle W can be between 15° and 65°. In these exemplary embodiments, the angle is between 20° and 60°.

In these exemplary embodiments, the supporting frame 1 is a cast part 8, produced in a casting process. The supporting frame 1 is preferably made of a light metal, e.g. aluminum or magnesium, or a light metal alloy.

As can be seen in FIG. 4 in particular, there are electrical wires 102 for the fan 101 in at least one of the legs 3 on the supporting frame 1. The leg 3 has at least one retainer 9 for this, which is in the J-shaped cross section. This retainer 9 is a rubber tube 10 in these exemplary embodiments. In FIGS. 4 and 5, two such wires 102 for the fan 101 are in two of the legs 3 on the supporting frame 1. Each of these legs 3 therefore has at least one such retainer 9.

As shown in FIG. 2, a cover plate 105 can be attached to the receiving space 2, e.g. with threaded fasteners 11, on the side facing away from the feet 4. The cover plate 105 thus covers and protects a drive 103 for the fan 101 shown by way of example in FIGS. 4 and 5.

An air flow path 202 flows through the heat exchanger 201, as indicated in FIG. 5. The fan 101 conveys air through this flow path 202 and thus through the heat exchanger 201. The fan 101 can be a high-voltage fan 104 with an output of at least 5 kW, e.g. between 5 kW and 15 kW. The fan 101 can weigh at least 4 kg, e.g. at least 10 kg.

The heat exchanger assembly 200 can be used, for example, in an electric truck (not shown).

The specification can be readily understood with reference to the following Numbered Paragraphs:

Numbered Paragraph 1. A supporting frame (1) for a fan (101) for a heat exchanger (201), which has a receiving space (2) for the fan (101) that is open in the axial direction (A), at least three legs (3) spaced apart over the circumference (U) for supporting the receiving space (2), that extend between the receiving space (2) and their feet (4) with which the supporting frame (1) is connected to the heat exchanger (201), wherein at least one of the legs (3) has a J-shaped cross section that has a base (5), with a first wall (6) and second wall (7) that extend away from the base (5), and wherein, the first wall (6) is downstream of the second wall (7) in a rotational direction (D) in relation to the axial direction (A), the first wall (6) has a first axial height (H1) and the second wall (7) has a second axial height (H2), starting from the base, and the second height (H2) is between 20% and 80%, in particular 30% and 70% of the first height (H1).

Numbered Paragraph 2. The supporting frame according to Numbered Paragraph 1, characterized in that the second height (H2) is between 10 mm and 40 mm, in particular between 15 mm and 35 mm.

Numbered Paragraph 3. The supporting frame according to Numbered Paragraph 1 or 2, characterized in that the first wall (6) and second wall (7) are tilted in relation to one another at an angle (W) between 15° and 65°, in particular between 20° and 60°.

Numbered Paragraph 4. The supporting frame according to any of the Numbered Paragraphs 1 to 3, characterized in that at least one of the legs (6, 7) has a retainer in its J-shaped cross section for an electrical wire (102) for the fan (101).

Numbered Paragraph 5. The supporting frame according to any of the Numbered Paragraphs 1 to 4, characterized in that the supporting frame (1) is a cast part (8), in particular made of light metal or a light metal alloy.

Numbered Paragraph 6. The supporting frame according to any of the Numbered Paragraphs 1 to 5, characterized in that the supporting frame (1) has a total of four such legs (3).

Numbered Paragraph 7. A fan assembly (100) for a heat exchanger (201), which has a supporting frame (1) according to any of the Numbered Paragraphs 1 to 6, and a fan (101), wherein the fan (101) is accommodated in the receiving space (2) and rotates in the rotational direction (D) when in use.

Numbered Paragraph 8. The fan assembly according to Numbered Paragraph 7, characterized in that the fan (101, 104) weighs at least 4 kg, in particular a least 10 kg, and/or is a high-voltage fan (103) with an output of at least 5 kW, in particular between 5 kW and 15 kW.

Numbered Paragraph 9. The fan assembly according to Numbered Paragraph 7 or 8, characterized by a cover plate (105) on the receiving space (2) on the side thereof facing away from the feet (4), which covers and mechanically protects a drive (103) for the fan (101).

Numbered Paragraph 10. A heat exchanger assembly (200), in particular for an electric vehicle, which has a heat exchanger (201) through which an air flow path (202) flows, and a fan assembly (100) according to any of the Numbered Paragraphs 7 to 9, wherein the fan assembly (100) is connected to the heat exchanger (101) by the feet (4), wherein the fan (101) conveys air in the flow path (202) through the heat exchanger (201).

LIST OF REFERENCE SYMBOLS

1 supporting frame
2 receiving space
3 leg
4 foot
5 base
6 first wall
7 second wall
8 cast part
9 retainer
10 tube
11 threaded fastener
100 fan assembly
101 fan
102 wire
103 drive
104 high-voltage fan
105 cover plate
200 heat exchanger assembly
201 heat exchanger
202 flow path
A axial direction
D rotational direction
H1 first height
H2 second height
R rotational axis
U circumference
W angle

The invention claimed is:

1. A supporting frame for a fan for a heat exchanger, comprising:

a receiving space for the fan that is open in an axial direction (A), at least three legs spaced apart over a circumference (U) configured for supporting the receiving space, the at least three legs each extend between the receiving space and respective feet, each of the at least three legs is attached to the respective foot, each respective foot is attached to the supporting frame, and the supporting frame is connected to the heat exchanger, wherein at least one of the legs has a J-shaped cross section that has a base, with a first wall and second wall that extends away from the base, and wherein, the first wall is downstream of the second wall in a rotational direction (D) in relation to the axial direction (A), the first wall has a first axial height (H1) and the second wall has a second axial height (H2), starting from the base, and the second height (H2) is between 20% and 80 of the first height (H1).

2. The supporting frame according to claim 1, wherein the second height (H2) is between 10 mm and 40 mm.

3. The supporting frame according to claim 2, wherein the second height (H2) is between 15 mm and 35 mm.

4. The supporting frame according to claim 1, wherein the first wall and second wall are tilted in relation to one another at an angle (W) between 15° and 65°.

5. The supporting frame according to claim 4, wherein the angle (W) is between 20° and 60°.

6. The supporting frame according to claim 1, wherein at least one of the legs has a retainer in its J-shaped cross section for an electrical wire for the fan.

7. The supporting frame according to claim 1, wherein the supporting frame is a cast part that is made of light metal or a light metal alloy.

8. The supporting frame according to claim 1, wherein the at least three legs comprises four legs.

9. A fan assembly for the heat exchanger, comprising the supporting frame according to claim 8, wherein the fan is accommodated in the receiving space and rotates in the rotational direction (D) when in use.

10. The fan assembly according to claim 9, wherein the fan weighs at least 4 kg, and/or is a high-voltage fan with an output of at least 5 kW.

11. The fan assembly according to claim 10, wherein the fan weighs at least 10 kg, and/or is a high-voltage fan with an output of between 5 KW and 15 KW.

12. The fan assembly according to claim 9, further comprising a cover plate on the receiving space on a side thereof facing away from the feet, the cover plate covers and mechanically protects a drive for the fan.

13. A heat exchanger assembly for an electric vehicle, comprising the fan assembly according to claim 9, wherein an air flow path flows through the heat exchanger;

wherein the fan assembly is connected to the heat exchanger by the feet, wherein the fan conveys air in the flow path through the heat exchanger.

14. The supporting frame according to claim 1, wherein the second height (H2) is between 30% and 70% of the first height (H1).

* * * * *